US005394664A

United States Patent [19]

Nowell

[11] Patent Number: 5,394,664

[45] Date of Patent: Mar. 7, 1995

[54] INTERLOCKING SKYLIGHT AND ROOF PANEL ASSEMBLY

[75] Inventor: Jeffrey A. Nowell, Hudson, Ohio

[73] Assignee: Patio Encolsures, Inc., Macedonia, Ohio

[21] Appl. No.: 135,282

[22] Filed: Oct. 12, 1993

[51] Int. Cl.[6] ..... E04B 7/18

[52] U.S. Cl. ..... 52/200; 52/90.1; 52/656.5; 52/762; 52/780

[58] Field of Search ..... 52/90.1, 92.1, 93.2, 52/200, 204.1, 208, 400, 656.5, 763, 764, 765, 770, 772, 775, 762, 778, 779, 780, 781

[56] References Cited

U.S. PATENT DOCUMENTS

| | | | |
|---|---|---|---|
| 2,682,938 | 7/1954 | MacDonald . | |
| 3,323,262 | 6/1967 | DiCesare, Jr. et al. | 52/764 X |
| 3,367,076 | 2/1968 | O'Brien . | |
| 3,479,784 | 11/1969 | Massagli . | |
| 3,571,997 | 3/1971 | Lindpointner | 52/779 X |
| 3,742,672 | 7/1973 | Schaeufele et al. . | |
| 3,760,548 | 9/1973 | Sauer et al. . | |
| 3,791,088 | 2/1974 | Sandow et al. . | |
| 4,114,330 | 9/1978 | Sukolics . | |
| 4,155,206 | 5/1979 | Player . | |
| 4,186,539 | 2/1980 | Harmon et al. . | |
| 4,373,312 | 2/1983 | Kim . | |
| 4,388,784 | 6/1983 | Jentoft et al. | 52/200 |
| 4,389,823 | 6/1983 | Player . | |
| 4,468,899 | 9/1984 | Miller | 52/200 X |
| 4,471,584 | 9/1984 | Dietrich | 52/200 X |
| 4,587,776 | 5/1986 | Leurent . | |
| 4,614,067 | 9/1986 | Matsubara . | |
| 4,638,613 | 1/1987 | Tonsmann . | |
| 4,658,559 | 4/1987 | Doherty . | |
| 4,686,805 | 8/1987 | Forslin | 52/208 |
| 4,769,963 | 9/1988 | Meyerson . | |
| 4,884,376 | 12/1989 | DeBlock et al. . | |
| 5,007,215 | 4/1991 | Minter . | |

FOREIGN PATENT DOCUMENTS

| | | | |
|---|---|---|---|
| 2444762 | 7/1980 | France . | |
| 1066701 | 4/1987 | United Kingdom . | |
| 2204627 | 11/1988 | United Kingdom | 52/200 |

*Primary Examiner*—Carl D. Friedman
*Assistant Examiner*—Kevin D. Wilkens
*Attorney, Agent, or Firm*—Fay, Sharpe, Beall, Fagan, Minnich & McKee

[57] ABSTRACT

An interlocking skylight and roof panel assembly includes a skylight unit having a glazing unit with a plurality of sides and a frame assembly secured around the glazing unit. The frame assembly includes a channel shaped first frame member having a first leg, a spaced second leg and a third leg interconnecting the first and second legs. Each of the first and second legs includes an inwardly turned flange. A roof panel includes a first skin, a spaced second skin and a panel of material secured therebetween. Defined along one edge of the roof panel are a pair of spaced channels. The inwardly turned flanges of the skylight unit frame assembly can be interlocked into the edge channels of the roof panel.

20 Claims, 6 Drawing Sheets

INTERLOCKING SKYLIGHT AND ROOF PANEL ASSEMBLY

BACKGROUND OF THE INVENTION

The present invention relates to skylight assemblies. More particularly, the present invention is concerned with a modular skylight that can be placed in a desired location on a roof and interlocked with adjacent panels of the roof.

Add-on rooms such as sun rooms of residential housing, have become popular. The add-on rooms can either be constructed from conventional building materials or from a prefabricated kit. Prefabricated add-on rooms are advantageous from the standpoint of simplicity of assembly and ease of handling. These aspects tend to hold down the otherwise high cost of these rooms. Such rooms often employ modular or multi-panel type roof systems. These generally include a series of spaced frame elements between which roof panels are secured.

One disadvantage, however, of such modular constructions is that a skylight is difficult to selectively integrate into the roof structure of this type of room. This is due to the prefabricated aspect of the roofing design and the necessity of uniform assembly methods. Oftentimes when a skylight is desired, a hole needs to be cut in the already assembled roof so that a skylight structure can be mounted in the hole. Even if the add-on room is constructed of conventional materials, the roof needs to be first built and then a hole needs to be cut in it so that a skylight can be mounted in the hole.

It is also known to construct modular type buildings using a plurality of interlocking panels for the walls of the building. These generally comprise pairs of sheet metal skins secured together in spaced parallel relationship and having a panel of thermoinsulating material between them. Opposed longitudinal marginal edges of these panels can be formed as mating tongues and sockets to interfit in assembled relationship with adjacent panels. However, these panels are merely used for the walls of the building and not its roof. In addition, the interlocking panels are wall elements, not windows or skylights.

One type of a modular skylight assembly that can be used with a modular roofing system is known. However, this type of assembly does not employ an integral skylight unit. Rather, the assembly includes a pair of unconnected skylight panel members comprising an outer roof member and an inner ceiling member. Each of these needs to be separately secured to adjacent roofing sections each having an outer roof panel and an inner ceiling panel. The outer skylight member has side edges that mate with side edges of the adjacent roof panels. The inner skylight member is supported by mounting clips from the adjacent ceiling panels. This structure does not facilitate the easy installation of the skylight assembly. The failure to utilize a modular design for the skylight, may also lead to air or water leaks and reduces the structural strength of the roof.

Accordingly, it has been considered desirable to develop a new and improved modular interlocking skylight and roof panel assembly which would overcome the foregoing difficulties and others while providing better and more advantageous overall results.

BRIEF SUMMARY OF THE INVENTION

In accordance with the present invention, a prefabricated skylight unit is provided.

More particularly in accordance with this aspect of the invention, the skylight unit comprises a glazing unit having a plurality of sides and a glazing boot encircling the glazing unit and being secured thereto. A frame assembly is secured around the glazing unit. The frame assembly comprises a first frame member comprising a first leg, a spaced second leg and a third leg interconnecting the first and second legs. Each of the first and second legs includes an inwardly turned flange.

Preferably the frame assembly further comprises a second frame member comprising a first leg, a spaced second leg and a third leg interconnecting the first and second legs. Preferably the glazing unit includes four sides wherein two of the first frame members are disposed on a first two opposed sides of the glazing unit and two of the second frame members are disposed on a second two opposed sides of the glazing unit. The first frame member first leg preferably comprises a finger for gripping a first portion of the glazing boot and the third leg includes a section which faces the first leg finger, the third leg section also comprises a finger for gripping a second portion of the glazing boot. Preferably, the first and third legs comprise facing sections which form respective sides of a channel for holding opposing faces of the glazing unit. The third leg also comprises a section which forms a base of the channel. The third leg preferably includes a thermal break to prevent a conduction of heat along the third leg.

In accordance with another aspect of the invention, an interlocking skylight and roof panel assembly is provided.

More particularly in accordance with this aspect of the invention, the skylight unit comprises a glazing unit having a plurality of sides and a frame assembly secured around the glazing unit. The frame assembly comprises a channel-shaped first frame member comprising a first leg, a spaced second leg and a third leg interconnecting the first and second legs. Each of the first and second legs includes an inwardly turned flange. A roof panel comprises a first skin, a spaced second skin and a panel of material secured therebetween. Defined along one edge of the roof panel are a first channel located in the first skin and a second channel located in the second skin. The roof panel channels can be interlocked with the inwardly turned flanges of the skylight unit first frame member.

Preferably, the frame assembly of the skylight unit further comprises a channel-shaped second frame member comprising a first leg, a spaced second leg and a third leg interconnecting the first and second legs. A fastener is preferably provided for securing the first frame member to the second frame member. The glazing unit preferably includes four sides and two of the first frame members are disposed on a first two opposed sides of the glazing unit and two of the second frame members are disposed on a second two opposed sides of the glazing unit. The second frame member can be secured to a structural beam. Preferably, the third leg includes a thermal break to prevent a conduction of heat along the third leg of the first frame member of the frame assembly of the glazing unit.

One advantage of the present invention is the provision of a new and improved prefabricated skylight unit which is not prone to leakage of air or water and is structurally rigid.

Another advantage of the present invention is the provision of a prefabricated skylight unit having a framing assembly secured around a thermally insulated glazing unit. The glazing unit can include a pair of glass panes separated by a spacer.

Still another advantage of the present invention is the provision of a prefabricated skylight unit which has a rigid frame. If the skylight unit is square or rectangular, four frame members are employed. The four frame members are secured together to form a rigid structure.

Yet another advantage of the present invention is the provision of a prefabricated skylight unit including a glazing unit and a frame assembly secured thereto. The skylight unit includes a thermal break on each conductive element.

An additional advantage of the present invention is the provision of an interlocking skylight and roof panel assembly.

A further advantage of the present invention is the provision of an interlocking skylight and roof panel assembly having a prefabricated skylight unit which is provided with a frame assembly having inwardly turned flanges. These flanges cooperate with channels provided along at least one edge of a roof panel. This enables the skylight unit to be interlocked with the roof panel.

A still further advantage of the present invention is the provision of a modular interlocking skylight and roof panel assembly which enables a skylight to be incorporated in a roof at the time of construction of the roof.

A yet further advantage of the present invention is the provision of a modular interlocking skylight and roof panel assembly in which the skylight does not detract from the structural strength of the modular roof but rather adds to it.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts a preferred embodiment of which will be described in detail in this specification and illustrated in the accompanying drawings which form a part hereof and wherein.

DETAILED DESCRIPTION OF THE PREFERRED EMBODIMENT

Figure 1:
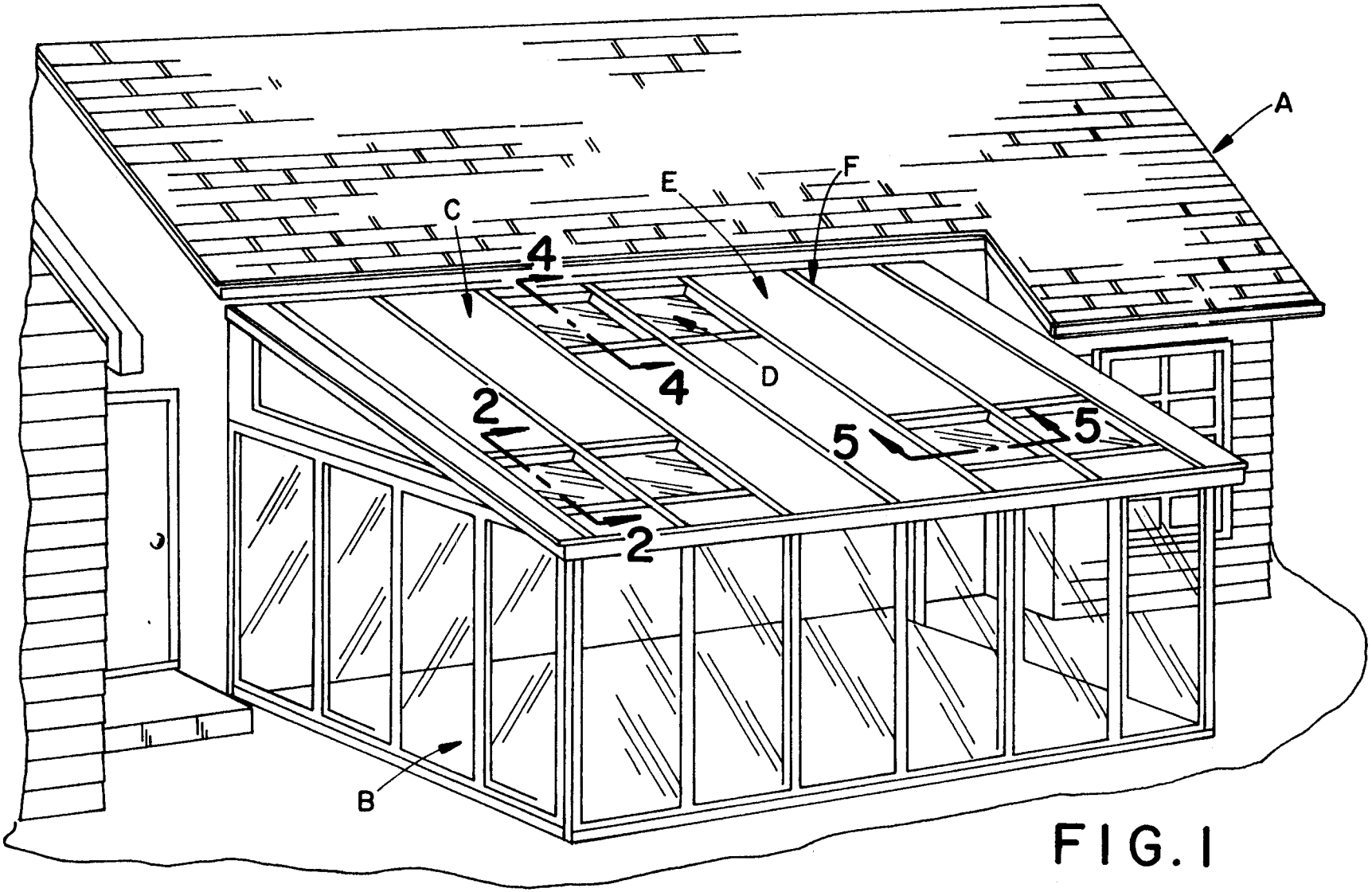
FIG. 1 is a perspective view of a patio room or sunroom employing an interlocking skylight and roof panel assembly according to the present invention.

Referring now to the drawings wherein the showings are for purposes of illustrating the preferred embodiment of the invention only and not for purposes of limiting same, FIG. 1 shows a house A having a patio B which has been enclosed with walls and a roof C. The roof is comprised of an interlocking skylight and roof panel assembly. This assembly includes a number of skylight units D and a series of roof panels E that are separated by structural beams F. While the skylight and roof panel assembly is illustrated as being used to enclose a patio or sunroom of a house, it should be appreciated that the invention can also be utilized for roofing structures in a variety of other environments such as sheds, utility buildings, greenhouses and the like. Also, this type of construction can be used for the walls of a structure and not just its roof.

Figure 2:
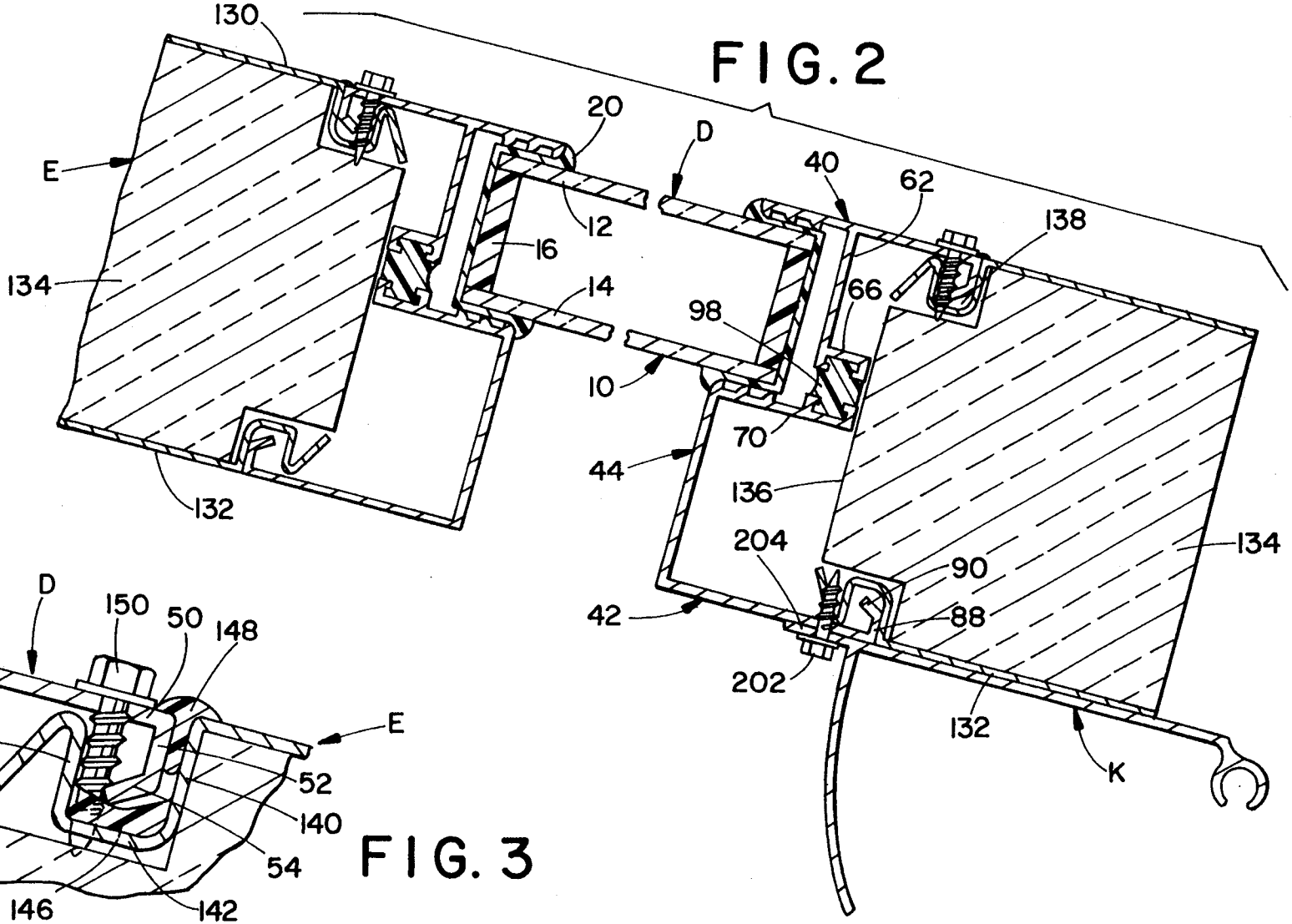
FIG. 2 is an enlarged cross-sectional view along the line 2—2 of the skylight and roof panel assembly of FIG. 1.

With reference now to FIG. 2, the skylight unit D comprises a glazing unit 10 having a first glass panel 12, a second glass panel 14 and a spacer element 16 located therebetween. The first glass panel 12 can be an outer panel which may have a bronzed coating on it. The spacer element 16 can be an insulated aluminum spacer. The second glass panel 14 can be an uncoated piece of glass. The glazing unit 10 therefore comprises a two pane insulated assembly which prevents the leakage of air or water and retards heat transfer. Of course, other types of known thermal pane type insulated glass constructions could also be employed.

Figure 6:
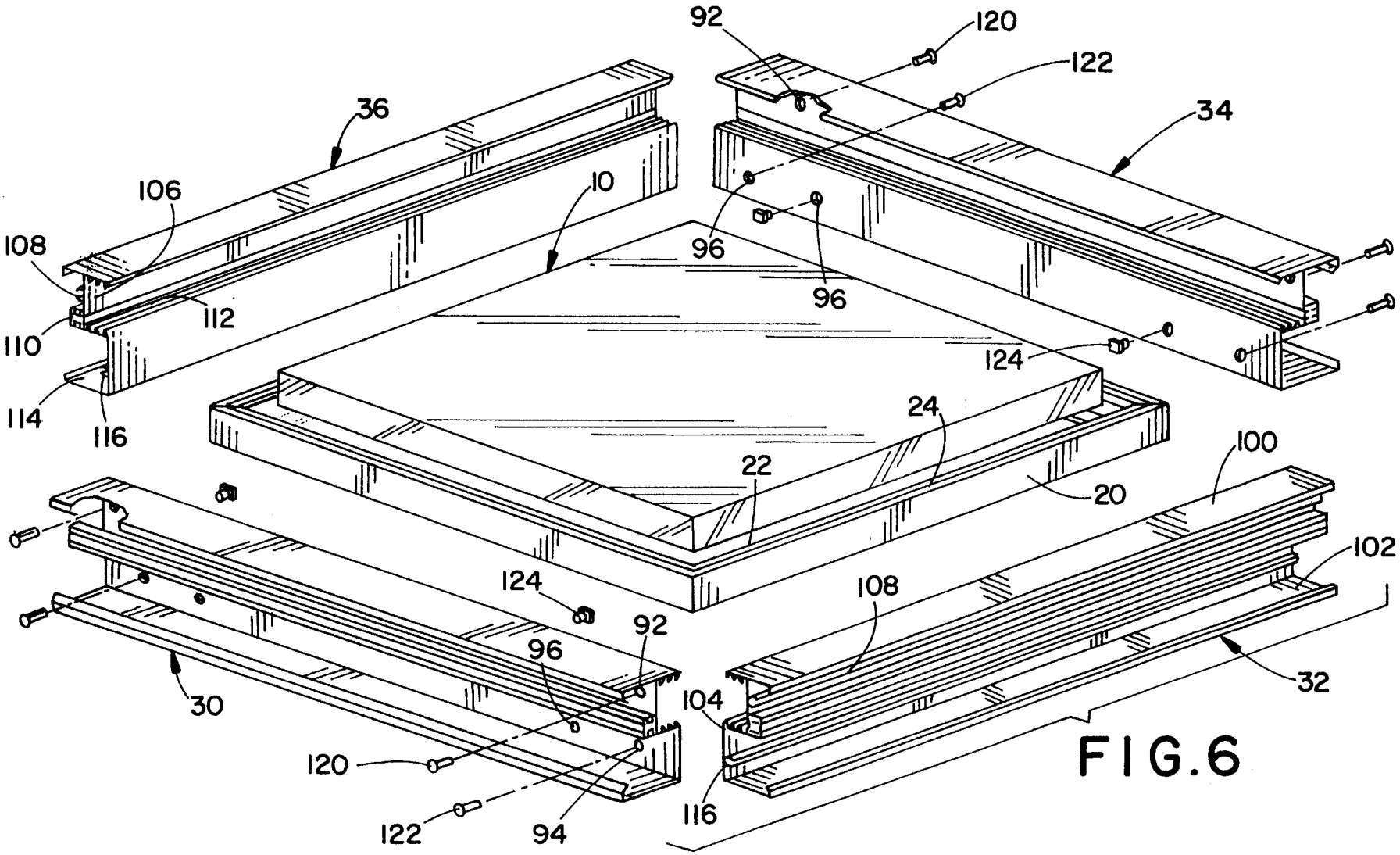
FIG. 6 is an exploded perspective view of a prefabricated skylight unit according to the present invention.

With reference now also to FIG. 6, stretched around the edges of glazing unit 10 is a glazing boot 20. This can be made of a suitable material such as, e.g., vinyl or the like. The glazing boot can have an upper surface 22 on which are disposed one or more longitudinally extending fins 24. A similar fin (not visible in FIG. 6) could also be provided along the bottom face of the glazing boot 20. A sealant material can be applied over the edges of the boot when secured to the glazing unit if so desired in order to prevent leaks.

Secured around the glazing unit and the boot is a frame assembly. This comprises first, second, third and fourth frame members 30, 32, 34 and 36 if the glazing unit is square. The four frame members can be made from a suitable conventional metallic material such as extruded aluminum. It should be appreciated that the glazing unit, and the frame assembly for it, could also be rectangular or have another well known shape such as a triangle, a hexagon or the like, depending on the desired shape of the skylight.

The first and third frame members 30 and 34 are female frame members. These are identical in their construction. Therefore, only the first frame member 30 will be described in detail herein, it being appreciated that the third frame member 34 has the identical construction.

Figure 7:
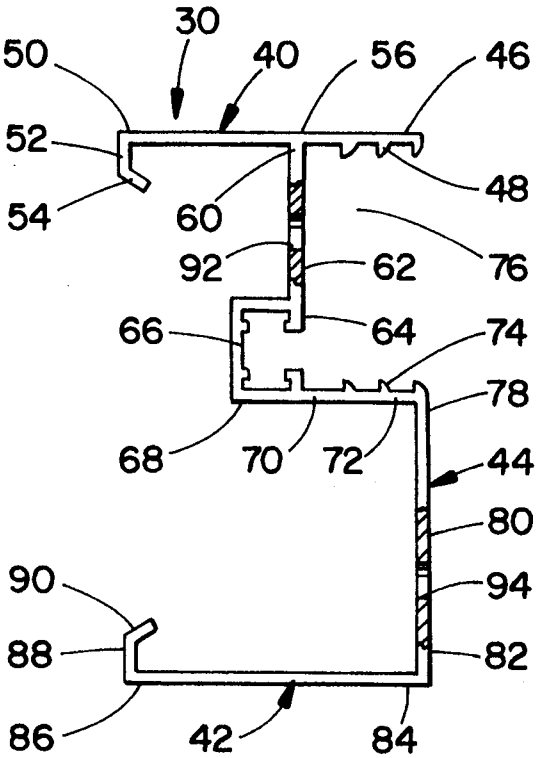
FIG. 7 is an end elevational view of a female frame member utilized in the prefabricated skylight unit of FIG. 6; and, FIG. 8 is a side elevational view of a portion of the female frame member of FIG. 7.

With reference now to FIG. 7, the first frame member 30 comprises a first leg 40, a spaced second leg 42 and a third leg 44 which interconnects the spaced first and second legs. The first leg 40 includes a first end 46 adjacent which are provided, on an inner surface thereof, a plurality of spaced longitudinally extending ribs 48. The first leg also includes a second end 50 extending from which is a depending arm 52 which terminates in an inwardly turned flange 54.

Extending from an intermediate section 56 of the first leg 40 is a first end 60 of a first section 62 of the third leg 44. The first section 62 also includes a second end 64 at which is defined a box section 66. The box section connects to a first end 68 of a second section 70 of the third leg. The second section also has a second end 72. Provided on one face of the second end 72 are a plurality of spaced longitudinally extending ribs or fingers 74. The spaced ribs 48 of the first leg 40 face the spaced ribs 74 of the third leg 44. Also, the first end 46 of the first leg 40 cooperates with the first section 62 and the second section 68 of the third leg 44 to form a channel 76. The frame member ribs 48 and 74 cooperate with the at least one fin 24 of the glazing boot 20 to form a fluid-tight joint.

Extending from the second end 72 of the second section 70 is a first end 78 of a third section 80 of the third leg. The third section terminates in a second end 82. Extending from the second end of the third leg third section is a first end 84 of the second leg 42. Located at a second end 86 of a second leg is an upstanding arm 88 which terminates in an inwardly turned flange 90. It can be seen that the flange 54 of the first leg 40 and the flange 90 of the second leg 42 extend towards each other and into the somewhat complex shaped channel that is formed by the cooperation of the first, second and third legs 40, 42 and 44 of the first or female frame member 30. The frame member 30 is preferably of one piece as manufactured. As mentioned, the frame member 30 can be manufactured from a suitable metallic material, such as extruded aluminum.

Figure 8:
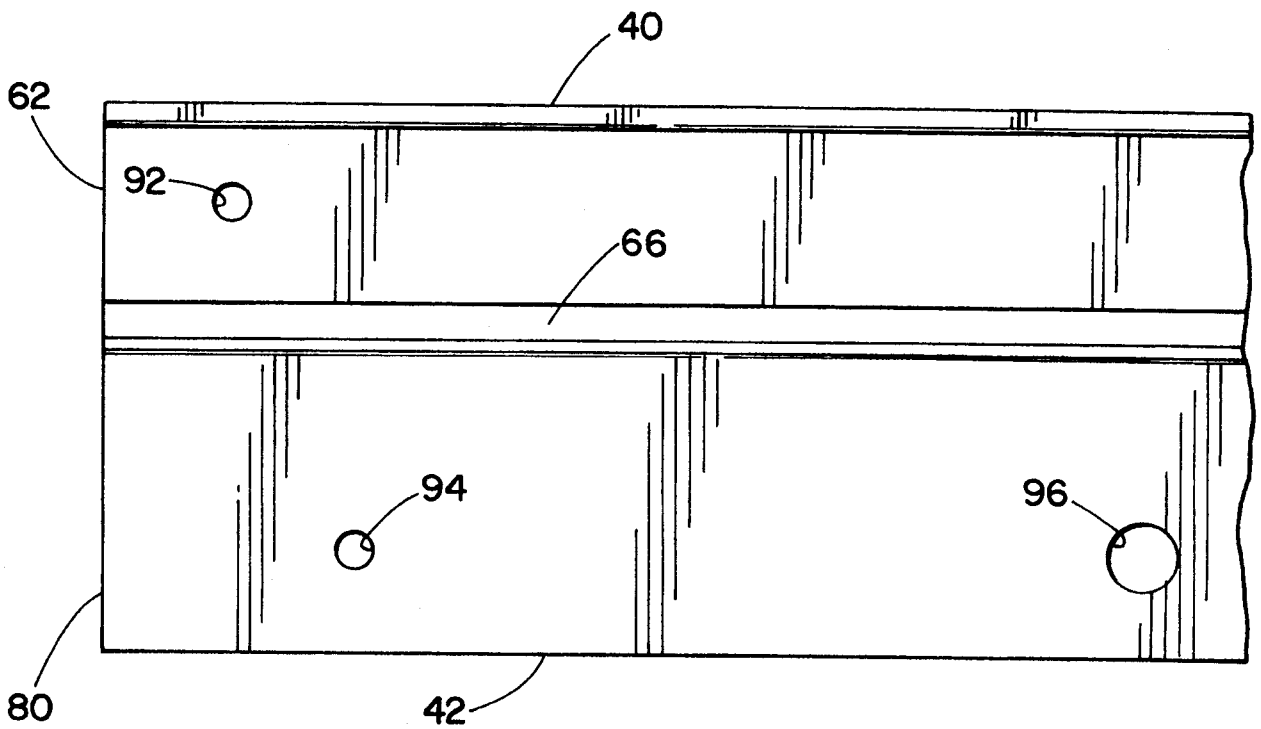

With reference now also to FIG. 8, extending through the first section 62 of the third leg is a first aperture 92. Extending through the third section 80 of the third leg is a second aperture 94. It can be seen that the first and second apertures 92, 94 are not aligned with each other. Thus, the second aperture 94 is further away from a left end of the first frame member 30 than is the first aperture 92. Also extending through the third section 80 is a third aperture 96 which is spaced from the second aperture 94 and is also of a larger diameter than the diameter of the second aperture.

Before installation of the female frame member 30 illustrated in FIG. 7, the box section 66 thereof is filled with a suitable thermoplastic material to form a thermal break 98 (see FIG. 2). Thereafter, the box section 66 is debridged. In other words, metal to metal contact between the first and second sections 62 and 70 of the third leg 44 is interrupted so as to prevent a conduction of heat therealong. The thermoplastic material can be a stiff polyurethane, if desired, or a similar conventional material.

With reference now again to FIG. 6, the second frame member 32 has a somewhat different construction from the first frame member 30. It should be noted that the second and fourth frame members 32 and 36 have an identical construction. Therefore, only the second frame member 32 will be described herein, it being appreciated that the fourth frame member 36 has the identical structure.

The second frame member 32 includes a first leg 100, a second leg 102 spaced therefrom and a third leg 104 which interconnects the first and second legs. The third leg 104 includes a first section 106 which includes a first fastener port 108 that extends longitudinally therealong to define a channel as may perhaps be best seen in FIG. 5. The first section also includes on one end thereof a box section 110 which leads to a second section 112 of the third leg. The second section then leads to a third section 114. Defined along the third section 114 is a second fastener port 116 which, again, is channel shaped and extends longitudinally along the third section 114 of the third leg 104 of the second frame member 32. As can be best seen in FIG. 5, a thermal break is provided in the box section 110.

A first fastener 120 is adapted to extend through the first aperture 92 of the first frame member 30 and into the first fastener port 108 of the second frame member 32. Similarly, a second fastener 122 is adapted to extend through the second aperture 94 of the first frame member 30 and into the second fastener port 116 of the second frame member 32. In this way, the first and second frame members can be secured together. It is evident from FIG. 6 that the first frame member 30 is similarly secured to the fourth frame member 36 and that the third frame member 34 is secured to both the second frame member 32 and the fourth frame member 36 in the same manner. In this way, a rigid frame assembly is assembled around the glazing unit 10.

The fasteners 120, 122 can be conventional sheet metal screws or the like. Once these screws are utilized, the frame becomes rigid and holds the glazing unit 10 in the channels 76 formed along each of the four edges of the frame structure.

Extending through the third aperture 96 located in the first frame member 30 is a grommet 124. It is evident from FIG. 6 that four such apertures 96 are provided, two on each of the first and third frame members 30, 34. Therefore, four such grommets 124 are provided, one extending through a respective one of the apertures 96. The grommets are meant to each receive a respective plunger for a conventional shade screen (not illustrated for the sake of simplicity) that can be selectively secured beneath the skylight assembly if desired. The grommets can be simply press fit into the apertures 96 after the frame assembly has been installed around the glazing unit.

Figure 3:
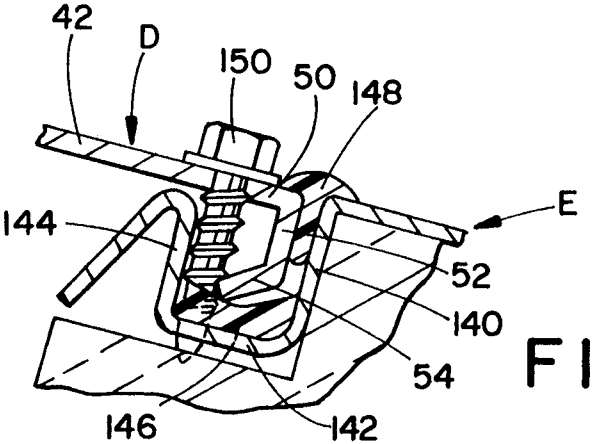
FIG. 3 is an enlarged cross-sectional view of a portion of the skylight and roof panel assembly of FIG. 2.

With reference again to FIG. 2, a roof panel E is there illustrated. The roof panel comprises a first skin 130 and spaced therefrom a second skin 132. A panel of material 134, such as an insulator, is positioned between the first and second skins. The insulator material can be, e.g., a foam or the like as is conventional. The two skins 130, 132 are adhered to the panel 134 as is well known in the art. Provided along one edge 136 of the panel E is a channel 138 formed in the first skin 130. With reference now also to FIG. 3, the channel 138 is defined by a first leg 140, a base portion 142 and a second leg 144. It is evident from FIG. 2 that such channels are formed along an edge of each of the first and second skins 130, 132. Extending into the channel 138 is the depending arm 52 and flange 54 located on a second end 50 of the first leg 40. Similarly extending into an identically shaped channel formed in the second skin 132 is the upstanding arm 88 and flange 90 of the second leg 42.

If desired, a first layer of sealant material 146 may be provided in the base 142 of the channel 138. Also, a second layer or bead of sealant material 148 can be provided to seal the gap formed between the upstanding arm 52 of the first frame member 30 and the leg 140 of the first skin member 130. If desired, a suitable fastener 150 can be used to insure that the snapped together edges of the skylight unit D and roof panel E do not separate.

Figure 5:
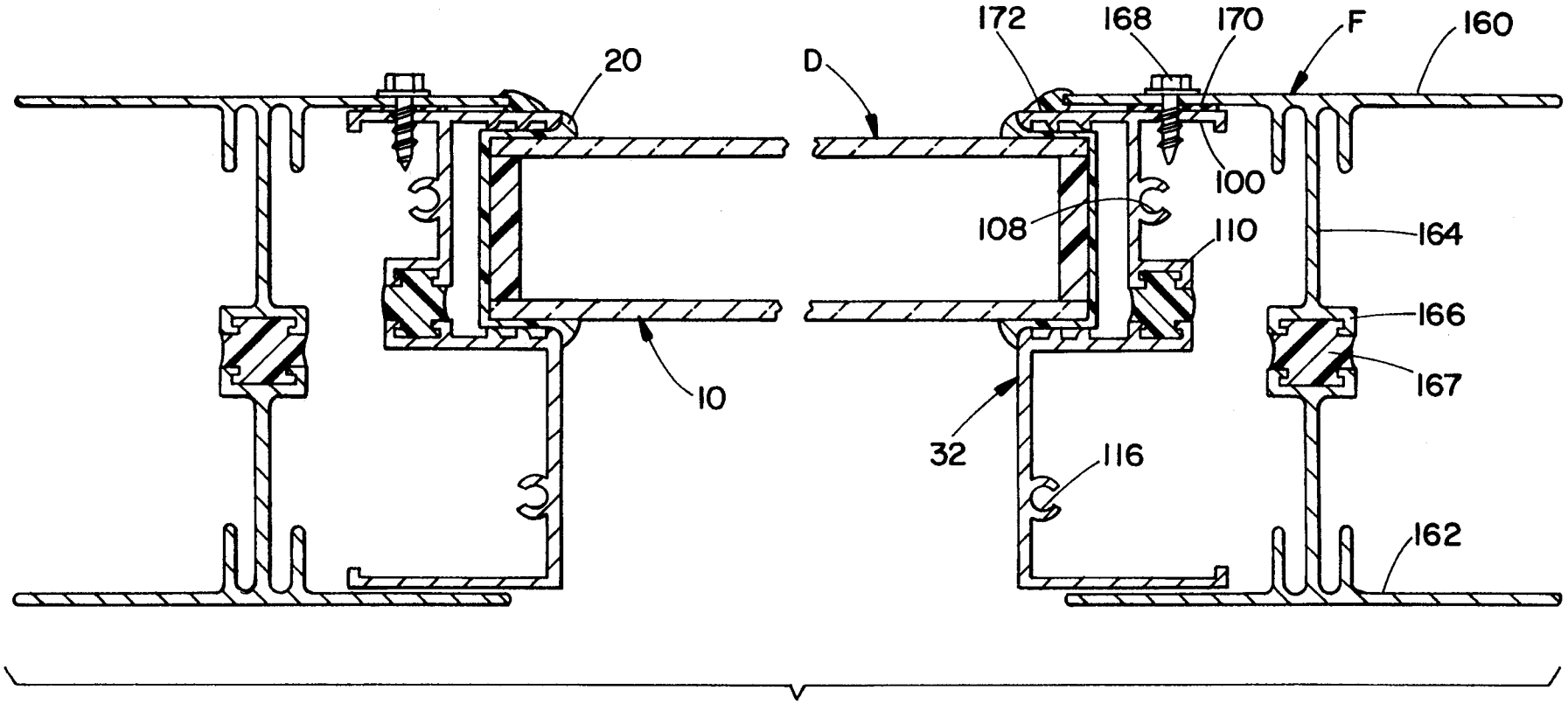
FIG. 5 is an enlarged cross-sectional view along line 5—5 of the skylight and roof panel assembly of FIG. 1.

It is evident from FIG. 1 that the cross-sectional view of FIG. 2 illustrates the interfitting relationship of the skylight unit D with adjacent roof panel sections E along two sides of the skylight unit. However, the other two sides of the skylight unit do not have roof panel sections adjacent thereto. Rather, as shown in FIG. 5, these two sides are secured to adjacent structural beams F.

The beams each include a first leg 160 and spaced therefrom a second leg 162. A third leg 164 interconnects the spaced first and second legs. The third leg 164 is provided with a box section 166 in which is provided a thermal break 167. This prevents the conduction of heat along the third leg from an exterior of the structure to an interior of the structure. As is well known in the art, the structural beam F can be made from extruded aluminum or the like. The thermal break 167 can be formed from a suitable thermoplastic material such as a stiff polyurethane. After the polyurethane is inserted in the box section 166, the section can be debridged. That is, the sides of the box section are removed so there is no metal to metal contact between the two portions of the third leg 164.

A fastener 168 can secure adjacent portions of the first leg 160 of the structural beam F to the first leg 100 of the second frame member 32. The fastener 168 can be a conventional sheet metal screw or the like as desired. Preferably, a first bead of sealant 170 is located between adjoining surfaces of the structural beam first leg 160 and second frame first leg 100. Also, preferably a second bead of sealant 172 is disposed adjacent an edge of the structural beam first leg 160 overlying the second frame first leg 100.

Figure 4:
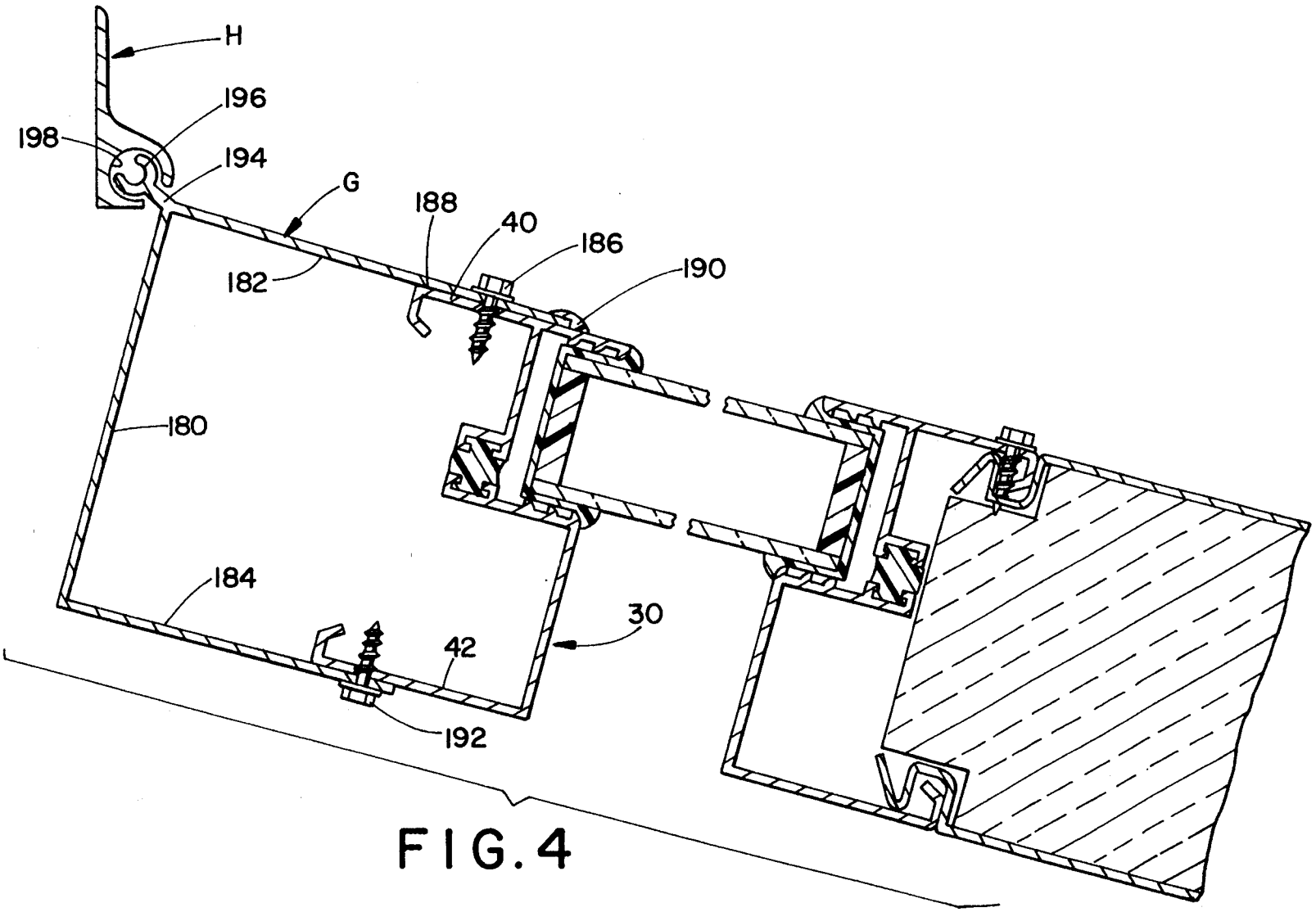
FIG. 4 is an enlarged cross-sectional view along line 4—4 of the skylight and roof panel assembly of FIG. 1.

With reference now also to FIG. 4, it can be seen that the integral skylight unit D cannot only be disposed between two roof panels E, but can also be disposed adjacent an edge of the roof structure if so desired. In this regard, the edge of the roof structure comprises a hanger assembly G which includes a base 180 and extending therefrom spaced first and second legs 182 and 184. The first leg 40 of the first frame member 30 extends adjacent to the first leg 182 of the hanger assembly G. These two members are secured together by a suitable fastener 186. Preferably, a bead of sealant material 188 is disposed therebetween. A second bead of sealant material 190 can be disposed adjacent an edge of the first leg 182 overlying the first frame member first leg 40. Also, if desired, a second fastener 192 can extend through the hanger assembly second leg 184 and the first frame member second leg 42 in order to secure these two elements together.

Extending from an edge defined between the base 180 and the first leg 182 of the hanger assembly G is an arm 194. This terminates in an enlarged section 196. The section is adapted to fit in a channel 198 of a hanger tab mounting member H. The hanger tab H can be nailed, lagged or similarly secured to a roof joist (not illustrated) as is well known in the art.

With reference again to FIG. 2, secured by a conventional fastener 202 to the second leg 42 of the frame member 30 and to the edge channel formed in the second skin member 132 is a flange 204 of a header assembly K. The header assembly is used to support a top edge of a side wall of the enclosure, as is well known in the art.

With reference again to FIG. 1, it can be seen that the skylight unit D is square in shape and can be approximately 36×36 inches in size if so desired. In contrast, the roof panels E can be anywhere from 6 to 15 feet in length, depending upon the size of the roof, and 36 inches wide. The structural beams F can be on the order of 3 inches high and 3 inches wide. The frame members 30, 32, 34 and 36 can also be on the order of 3 inches high. The first and third panel members 30 and 34, which have the inwardly turned flanges 54 and 90, can be on the order of 1.65 inches wide. In contrast, the second and fourth frame members 32 and 36 which do not have inwardly turned flanges, can be on the order of 1.27 inches wide.

The invention has been described with reference to a preferred embodiment. Obviously, modifications and alterations will occur to others upon the reading and understanding of the specification. It is intended to include all such modifications and alterations insofar as they come within the scope of the appended claims or the equivalents thereof.

I claim:

1. A prefabricated skylight unit and roof panel assembly comprising:

a skylight comprising:

a glazing unit having a plurality of sides;

a glazing boot encircling said glazing unit and being secured thereto;

a frame assembly secured around said glazing unit, said frame assembly comprising a first frame member comprising a first leg, a spaced second leg and a third leg interconnecting said first and second legs, each of said first and second legs including an inwardly turned flange; and, a roof panel having edge grooves which are selectively interlocked with said inwardly turned flanges of said frame assembly first and second legs.

2. The assembly of claim 1 wherein said frame assembly further comprises a second frame member comprising a first leg, a spaced second leg and a third leg interconnecting said first and second legs.

3. The assembly of claim 2 wherein said glazing unit includes four sides and wherein two of said first frame members are disposed on a first two opposed sides of said glazing unit and two of said second frame members are disposed on a second two opposed sides of said glazing unit.

4. The assembly of claim 1 wherein said first frame member first leg comprises a finger for gripping a first portion of said glazing boot and wherein said third leg includes a section which faces said first leg finger, said third leg section comprising a finger for gripping a second portion of said glazing boot.

5. The assembly of claim 1 wherein said first and third legs comprise facing sections which form respective sides of a channel for holding opposing faces of said glazing unit, said third leg also comprising a section which forms a base of said channel.

6. The assembly of claim 1 wherein said third leg includes a thermal break to prevent a conduction of heat along said third leg.

7. A modular roofing structure having a skylight, the structure comprising: a skylight unit comprising:

a glazing unit having a plurality of sides, and a frame assembly secured around said glazing unit, said frame assembly comprising a channel-shaped first frame member comprising a first leg, a spaced second leg and a third leg interconnecting said first and second legs, each of said first and second legs including an inwardly turned flange; and, a roof panel comprising a first skin, a spaced second skin and a panel of material secured therebetween, said first and second skins comprising edge grooves, wherein said roof panel edge grooves are selectively interlocked with said inwardly turned flanges of said first frame member.

8. The roofing structure of claim 7 wherein said frame assembly further comprises a channel-shaped second frame member comprising a first leg, a spaced second leg and a third leg interconnecting said first and second legs.

9. The roofing structure of claim 8 wherein said glazing unit includes four sides and wherein two of said first frame members are disposed on a first two opposed sides of said glazing unit and two of said second frame members are disposed on a second two opposed sides of said glazing unit.

10. The roofing structure of claim 7 wherein said first frame member first leg comprises a finger for holding a gasket wherein said third leg includes a section which faces said first leg finger, said third leg comprising a finger for holding said gasket.

11. The roofing structure of claim 7 wherein said first and third legs comprise facing sections which form respective sides of a channel for holding opposing faces of said glazing unit, said third leg also comprising a section which forms a base of said channel.

12. The roofing structure of claim 7 wherein said third leg includes a thermal break to prevent a conduction of heat along said third leg.

13. The roofing structure of claim 7 further comprising a fastener for securing said frame member to said roof panel.

14. The roofing structure of claim 7 further comprising a sealant material covering a joint formed between an interlocked roof panel edge groove and said first frame member.

15. An interlocking skylight and roof panel assembly comprising:

a skylight unit comprising:

a glazing unit having a plurality of sides, and a frame assembly secured around said glazing unit, said frame assembly comprising a channel-shaped first frame member comprising a first leg, a spaced second leg and a third leg interconnecting said first and second legs, each of said first and second legs including an inwardly turned flange; and, a roof panel comprising a first skin, a spaced second skin and a panel of material secured therebetween, defined along one edge of said roof panel are a first channel located in said first skin and a second channel located in said second skin, wherein said roof panel edge channels are selectively interlocked with said inwardly turned flanges of said skylight unit first frame member.

16. The roofing structure of claim 15 wherein said frame assembly further comprises a channel-shaped second frame member comprising a first leg, a spaced second leg and a third leg interconnecting said first and second legs.

17. The assembly of claim 16 further comprising a fastener for securing said first frame member to said second frame member.

18. The roofing structure of claim 16 wherein said glazing unit includes four sides and wherein two of said first frame members are disposed on a first two opposed sides of said glazing unit and two of said second frame members are disposed on a second two opposed sides of said glazing unit.

19. The roofing structure of claim 18 further comprising a structural beam to which one of said second frame members are selectively secured.

20. The roofing structure of claim 15 wherein said third leg includes a thermal break to prevent a conduction of heat along said third leg.

* * * * *